US005184452A

United States Patent [19]

Stahlecker et al.

[11] Patent Number: 5,184,452

[45] Date of Patent: Feb. 9, 1993

[54] METHOD AND APPARATUS FOR DRIVING AN OPEN-END SPINNING MACHINE WITH A TANGENTIAL BELT DURING PIECING

[75] Inventors: Fritz Stahlecker, Josef-Neidhart-Strasse 29, 7347 Bad Überkingen; Dieter Götz, Geislingen/Steige, both of Fed. Rep. of Germany

[73] Assignees: Fritz Stahlecker; Hans Stahlecker, both of Fed. Rep. of Germany

[21] Appl. No.: 841,786

[22] Filed: Mar. 2, 1992

Related U.S. Application Data

[63] Continuation of Ser. No. 626,431, Dec. 12, 1990, abandoned.

[30] Foreign Application Priority Data

Dec. 21, 1989 [DE] Fed. Rep. of Germany ..... 3942402

[51] Int. Cl.[5] ..... D01H 13/00; D01H 15/00

[52] U.S. Cl. ..... 57/105; 57/78; 57/263

[58] Field of Search ..... 57/104, 105, 78, 263

[56] References Cited

U.S. PATENT DOCUMENTS

| | | | |
|---|---|---|---|
| 3,868,815 | 3/1975 | Stahlecker | 57/105 |
| 4,058,966 | 11/1977 | Raasch | 57/104 |
| 4,070,814 | 1/1978 | Goldammer et al. | 57/105 X |
| 4,080,775 | 3/1978 | Stahlecker | 57/78 X |
| 4,163,359 | 8/1979 | Honjo | 57/105 X |
| 4,574,577 | 3/1986 | Derichs et al. | 57/105 X |
| 4,660,372 | 4/1987 | Stahlecker | 57/105 X |
| 4,660,373 | 4/1987 | Derichs | 57/105 X |
| 4,703,616 | 11/1987 | Feuchter | 57/105 |
| 4,763,469 | 8/1988 | Stahlecker et al. | 57/105 X |
| 4,785,620 | 11/1988 | Feuchter | 57/105 X |
| 4,899,528 | 2/1990 | Fahmuller et al. | 57/104 X |

FOREIGN PATENT DOCUMENTS

| | | |
|---|---|---|
| 2803052 | 7/1979 | Fed. Rep. of Germany . |
| 3401315 | 7/1985 | Fed. Rep. of Germany . |
| 3613843 | 10/1987 | Fed. Rep. of Germany . |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In the case of a tangential-belt drive for an open-end spinning machine, having a tangential belt driving the spinning rotors of several spinning units arranged behind one another, it is provided that the spinning units each comprise a pressure roller loading the tangential belt and a rotor brake which can be jointly actuated by means of a common actuating mechanism. In addition, an actuating possibility is provided by means of which the pressure roller, for increasing the pressure force, can be increasingly pressed against the tangential belt during the run-up.

20 Claims, 1 Drawing Sheet

METHOD AND APPARATUS FOR DRIVING AN OPEN-END SPINNING MACHINE WITH A TANGENTIAL BELT DURING PIECING

This is a continuation of application Ser. No. 07/626,431, filed Dec. 12, 1990 abandoned.

BACKGROUND AND SUMMARY OF THE INVENTION

The invention relates to a tangential-belt drive for an open-end spinning machine of the type having a tangential belt driving the spinning rotor shafts of several spinning units arranged next to one another. The spinning units each include a pressure roller which presses the tangential belt by means of an elastic pressure force against the respective spinning rotor shaft. A rotor brake is provided at each spinning unit which can be actuated by means of an actuating mechanism in such a manner that the pressure roller is lifted off the tangential belt during braking.

A tangential-belt drive of the initially mentioned type is known, for example, from the German Patent Document DE-A 36 13 843. As known also from the German Patent Document DE-A 28 03 052, the actuating mechanism is operated by a piecing carriage which can be moved along the machine and can be applied to the individual spinning units. By way of the piecing carriage, the actuating mechanism is operated such that the spinning rotor shaft is braked before the piecing operation so that then the piecing will take place while the spinning rotor is accelerated again to its rotational operating speed by means of the tangential belt which continues to move at an unreduced speed. In this case, the pressure force of the pressure roller provides that the run-up time from the stoppage to the rotational operating speed will not be too long also in the case of extremely high rotational speeds of the rotor which nowadays may clearly be above 100,000 $min^{-1}$ (100,000 revolution per minute).

On the basis of the German Patent Document DE-A 34 01 315, a belt drive for spinning rotors is also known in which the slip is reduced during the piecing operation so that the time period can be reduced which the spinning rotor requires for the run-up from stoppage to its rotational operating speed.

It is an object of the invention to develop a tangential-belt drive of the initially mentioned type such that the consumption of energy may be reduced.

This object is achieved in that the actuating mechanism comprises an actuating lever which is connected with the pressure roller in such a manner that, if it is operated when the brake is released, the pressure roller can be pressed against the tangential belt by means of a supplementary force which increases the pressure force.

In this case, the invention is based on the recognition that nowadays the elastic pressure force is frequently higher than is actually necessary. For the normal spinning operation, a relatively low pressure force is sufficient in order to ensure a secure driving of the spinning rotors at which the given rotational speed is maintained. However, in order to exclude a higher slip during the piecing and during the run-up phase utilized in this case, a much higher pressure force must be provided. This higher driving force which is not required during the normal operation, however, has the effect that deformations of the tangential belt may be caused in the area of the spinning rotor shafts which are connected with an increased power consumption. By means of the invention, it is now possible to make the required higher pressure force available only during the piecing while, in the normal operation, the lower pressure force is sufficient which will then cause a smaller deformation o the tangential belt so that the power consumption can be reduced.

Other objects, advantages and novel features of the present invention will become apparent from the following detailed description of the invention when considered in conjunction with the accompanying drawings.

DETAILED DESCRIPTION OF THE DRAWINGS

Figure 1:
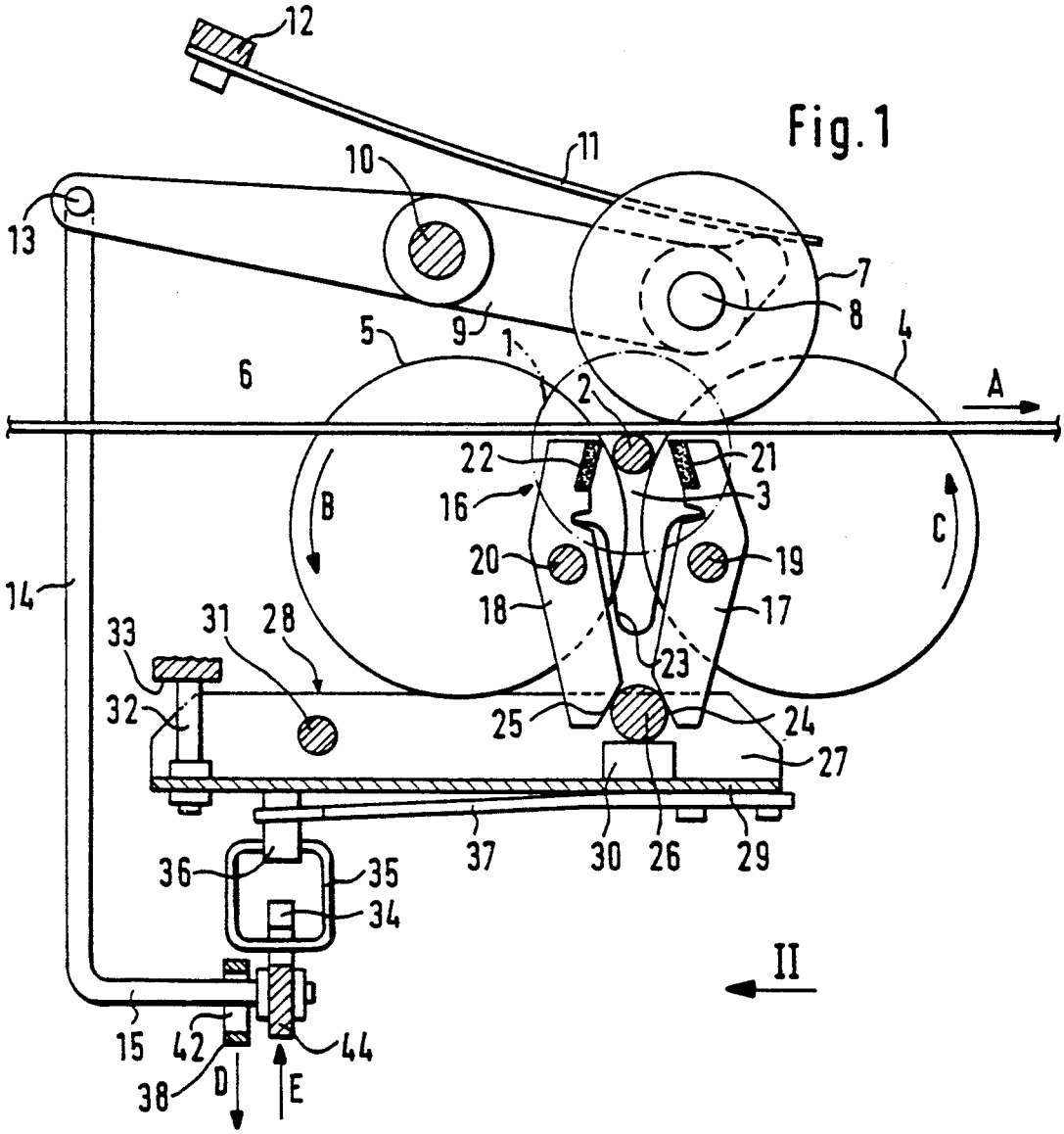
FIG. 1 is a schematic partial sectional view of a preferred embodiment of an individual spinning unit of an open-end rotor spinning machine, in which case only the elements are shown which are needed for the tangential-belt drive.
Figure 2:
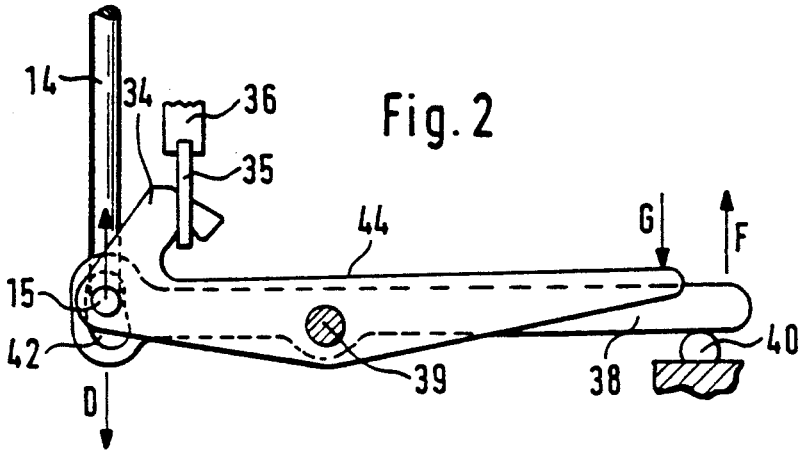
FIG. 2 is a view of a detail of FIG. 1 in the direction of the arrow 11 of FIG. 1.

In FIG. 1, the rotor plate 1 of a spinning rotor assembly is outlined only by means of dash-dotted lines. This rotor plate 1 is non-rotatably arranged on a rotor shaft 2 which is disposed in the wedge-shaped gaps 3 of two pairs of supporting disks 4, 5 arranged axially behind one another. The pairs of supporting disks 4, 5 arranged on the right and on the left of the rotor shaft 2 respectively each have a shaft with a bearing, the shafts being slightly inclined with respect to one another for producing an axial thrust affecting the rotor shaft 2. The end of the rotor shaft 2 which is opposite the rotor plate 1 is supported against this axial thrust in an axial bearing which is not shown.

The rotor shaft 2 is driven by a tangential belt 6 which holds the rotor shaft 2 in the wedge-shaped gaps 3 of the pairs of supporting disks 4, 5. The tangential belt 6 travels through in the direction of the arrow (A) in the longitudinal direction of the machine and drives the spinning rotors of all spinning units of one side of the machine. The pairs of supporting disks 4, 5 are also driven by way of the rotor shaft 2 so that they rotate in the direction of the arrows (B and C).

On the side situated opposite the wedge-shaped gaps 3, a pressure roller 7 is assigned to each rotor shaft 2 and, in direct proximity of the rotor shaft 2, loads the tangential belt 6 in the direction of the rotor shaft 2. The pressure roller 7 is freely rotatably disposed on a shaft 8 of a lever 9 which can be swivelled around a shaft 10 extending in parallel to rotor shaft 2. A leaf spring 11 which causes the pressure force is applied to the lever 9. The leaf spring 11 is fixedly arranged on a machine part by means of a holder 12.

A tongs-type brake 16 is assigned to the rotor shaft 2 and is arranged on the side of the tangential belt 6 situated opposite the pressure roller 7. The brake 16 comprises two tongs-type arms 17, 18 which can be swivelled around shafts 19, 20 which are in parallel to the rotor shaft 2 and which are provided with brake linings 21, 22 at their ends opposite the rotor shaft 2. In the brake released position, the two tongs-type arms 17, 18 are held by means of a spreading spring 23 which is constructed as a bow spring.

The ends of the double-armed tongs-type arms 17, 18 situated opposite the brake linings 21, 22 are constructed as sliding surfaces 24, 25 which converge diagonally in the direction of the shafts 19 20 and between which a roller 26 engages. The roller 26 is held by means of a lever 28 which can be swivelled around a shaft 31 which is parallel to rotor shaft 2. The roller 26 is rotatably arranged between the legs 27 of the lever 28 which lever 28 has a U-shaped cross-section. With respect to the transverse web 29 of the lever 28, the roller 26 is supported by means of a pressure piece 30. The illustrated released position of the brake 16 is determined by an adjustable stop pin 32 mounted on the lever 28 which supports itself against a stop 33 fixed on the machine.

The brake 16 and the pressure roller 7, by way of a common actuating mechanism, are connected with one another such that, when the brake 16 is closed, that is, when the brake linings 21, 22 are placed against the rotor shaft 2, the pressure roller 7 is lifted off the tangential belt 6 against the effect of the loading spring 11. At the arm of the lever 9 which is opposite the pressure roller 7, a rod 14 is pivotally connected by way of a joint 13, the lower end 15 of the rod 14 which is bent at a right angle, being connected With a brake lever 38. The brake lever 38 can be swivelled around a shaft 39 extending in the longitudinal direction of the machine. The brake lever 38, with one end, by means of an oblong hole 42, is hung into the bent end 15 of the rod 14. Its other arm rests on a stop 40 fixed on the machine. At the bent end 15 of the rod 14, another actuating lever 44 is also mounted which can also be swivelled around the shaft 39 and which is disposed essentially in parallel to the brake lever 38. The ends of the actuating lever 44 and of the brake lever 38 project out of the front side of the spinning unit so that they are accessible to corresponding actuating levers of a servicing carriage which is not shown and can be moved along the front side of the spinning machine. In the area of the bent end 15 of the rod 14, the actuating lever 44 is provided with a driving hook 34 into which a ring 35 is hung. The ring 35 is mounted on a connecting piece 36 which, by way of a leaf spring 37, is connected with the lever 28. The leaf spring 37 is fastened to the transverse web 29 of the lever 28 which has a U-shaped cross-section. With respect to the swivel shaft 31 of the lever 28, the connecting piece 36 is disposed on the side which is opposite the roller 26.

For the braking, the outwardly projecting end of the brake lever 38 is gripped by an actuating element of the servicing carriage and is swivelled upwards counterclockwise in the direction of the arrow (F). As a result, the end which is opposite with respect to the swivel shaft 39 is lowered in the direction of the arrow (D) so that the brake lever 38, after overcoming the play provided by the oblong hole 42, takes along the rod 14 and also the actuating lever 44. By way of the hook-shaped driving device 34, the ring 35 and the transition piece 36, the lever 28 will then also be taken along so that it is swivelled counterclockwise. Thus, the roller 26 is pressed between the sliding surfaces 24, 25 of the tongs-type arms 17, 18 so that the brake linings 21, 22 are placed against the rotor shaft 2 of the spinning rotor. When the brake lever 38 is moved farther in the direction of the arrow (F), the leaf spring 37 will then yield so that the force of the leaf spring 37 determines the force by which the brake linings 21, 22 press against the rotor shaft 2. After overcoming the play determined by the oblong hole 42, the rod 14 will then also be taken along so that the pressure roller 7 is swivelled counterclockwise and is lifted off the tangential belt 6. The tangential belt 6 will then move over the shaft while the pressure is reduced also when the brake 16 is switched on.

During the piecing at the respective spinning unit, the brake 16 will then be released again so that the rotor shaft 2 is accelerated again by the tangential belt 6 and is run up to its rotational operating speed. For this purpose, the brake lever 38 is first swivelled back into the shown position. The spreading spring 23 than presses the tongs-type arms 7, 18 apart so that, by way of the sliding surfaces 24, 25, the roller 26 and thus the lever 28 are pressed back into the illustrated position. In this case, the pressure roller 7 is also pressed back into its operating position by the loading spring 11. In order to reduce the run-up time which the spinning rotor requires in order to run up again to its rotational operating speed by means of an increased pressure force of the pressure roller 7 and thus of an increased pressing of the tangential belt 6 against the rotor shaft 2, the actuating lever 44, in this case, is also operated by a separate actuating element of the servicing carriage. At its end projecting out of the spinning unit, it is loaded by a given force in the direction of the arrow (G). The end of this actuating lever 44 which is connected with the bent end 15 of the rod 14 will then be lifted clockwise in the direction of arrow (E) so that the pressure roller 7 is swivelled clockwise and, by means of a supplementary load which is operative in addition to the pressure force of the leaf spring 11, is pressed against the tangential belt 6.

Because of this supplementary loading of the pressure roller 7 applied by the servicing carriage, it is possible to design the leaf spring 11 to be weaker, that is, to design it in such a manner that the driving force generated by it which is transmitted by the pressure roller 7 to the tangential belt 6 is provided to be only such that a driving force exists between the tangential belt 6 and the rotor shaft 2 which is sufficient for the normal spinning operation. During this normal operation, the tangential belt 6, in the area of the rotor shaft 2, therefore experiences only a relatively slight deflection so that the energy consumption required for this purpose is reduced. During the accelerating phase, the supplementary force leads to a stronger loading of the tangential belt 6 and thus also to a more extensive winding-around in the area of the rotor shaft 2 so that the driving force that can be transmitted in this case is increased for a short time.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Open-end spinning apparatus comprising:

a tangential belt for driving a plurality of spinning rotor shafts, a pressure applying device for pressing the tangential belt with a pressure force against the respective rotor shafts during normal spinning operations, a rotor shaft brake for applying braking forces to respective ones of the rotor shafts, a brake actuating device for actuating the brake to apply braking forces to a respective rotor shaft while decreasing the pressure force applied by the pressure applying device on the tangential belt against the respective rotor shaft during braking of the respective rotor shaft to accommodate a subsequent piecing operation, and a supplementary actuating device, in addition to the pressure applying device for temporarily increasing the pressure force applied by the pressure applying device on the tangential belt to a level above the pressure force applied to the respective rotor shaft during normal spinning operations so as to provide for acceleration of the respective rotor shaft during piecing operations.

2. Apparatus according to claim 1, wherein a plurality of spinning units with respective rotor shafts are driven by the tangential belt means, and wherein each spinning unit includes pressure applying means, rotor shaft brake means, brake actuating means, and supplementary actuating means.

3. Apparatus according to claim 2, further comprising a mobile servicing unit which includes means for selectively actuating the brake actuating means and supplementary actuating means at respective ones of said spinning units, thereby facilitating piecing operations.

4. Apparatus according to claim 3, wherein the pressure applying means is a pressure roller.

5. Apparatus according to claim 4, wherein the supplementary actuating means comprises an intermediate member which permits an application movement of the pressure applying means without any adjusting of the brake means.

6. Apparatus according to claim 4, wherein the supplementary actuating means includes an actuating lever for the pressure applying means which is arranged on a common shaft next to a brake lever of the brake means and is aligned in parallel to this brake lever.

7. Apparatus according to claim 4, wherein the actuating lever is connected with the pressure applying means without any play.

8. Apparatus according to claim 1, wherein the supplementary actuating means comprises an intermediate member which permits an application movement of the pressure applying means without any adjusting of the brake means.

9. Apparatus according to claim 8, wherein the pressure applying means is a pressure roller.

10. Apparatus according to claim 1, wherein the supplementary actuating means includes an actuating lever for the pressure applying means which is arranged on a common shaft next to a brake lever of the brake means and is aligned in parallel to this brake lever.

11. Apparatus according to claim 10, wherein the actuating lever is connected with the pressure applying means without any play.

12. Apparatus according to claim 10, wherein the pressure applying means is a pressure roller.

13. Apparatus according to claim 1, wherein the pressure applying means is a pressure roller.

14. Open-end spinning apparatus comprising:

a tangential belt for driving a plurality of spinning rotor shafts, a pressure applicator for pressing the tangential belt with a pressure force against the respective rotor shafts during normal spinning operations, and a supplemental pressure applicator, in addition to the pressure applicator, for temporarily increasing the pressure force applied by the pressure applicator on the tangential belt to a level above the pressure force applied to the respective rotor shaft during normal spinning operations so as to shorten the acceleration time of the respective rotor shaft during a piecing operation when the respective rotor shaft is accelerated from a standstill to its spinning speed.

15. Apparatus according to claim 14, wherein said pressure applicator includes a pressure roller engageable with the tangential belt.

16. Apparatus according to claim 15, wherein said pressure applicator includes a lever acting on the pressure roller and a spring acting on the lever.

17. Apparatus according to claim 16, wherein said supplementary pressure applicator includes a second lever connected to the first lever.

18. A method for open-end spinning comprising:

driving a plurality of spinning rotor shafts with a tangential belt with pressing of the tangential belt with a pressure force against the respective rotor shafts during normal spinning operations, and temporarily increasing the pressure force applied on the tangential belt to a level above the pressure force applied at a respective rotor shafts during normal spinning operations so as to shorten the acceleration time of the respective rotor shaft during a piecing operation when the respective rotor shaft is accelerated from a standstill to its spinning speed.

19. A method according to claim 18, wherein said pressing of the tangential belt comprises pressing a pressure roller against the tangential belt.

20. A method according to claim 19, wherein said pressing of the tangential belt includes spring biasing a first lever carrying the pressure roller, and wherein said temporarily increasing the pressure force includes forcibly moving a second lever connected to the first lever.

* * * * *